US007033244B1

(12) United States Patent
Barton

(10) Patent No.: US 7,033,244 B1
(45) Date of Patent: Apr. 25, 2006

(54) BRA FOR POSTPARTUM NON NURSING MOTHERS

(76) Inventor: Elliot J. Barton, 240 Wave Rd., Manahawkin, NJ (US) 08050

( * ) Notice: Subject to any disclaimer, the term of this patent is extended or adjusted under 35 U.S.C. 154(b) by 0 days.

(21) Appl. No.: 11/028,175

(22) Filed: Jan. 3, 2005

(51) Int. Cl.
*A41C 3/00* (2006.01)

(52) U.S. Cl. ..... 450/63; 450/36; 450/37; 450/57

(58) Field of Classification Search ..... 450/63, 450/64, 77, 79, 80, 82, 85, 86, 88, 54–58, 450/37, 38, 39, 36, 93; 607/108, 109, 112, 607/110; 2/92, 267, 268, 104
See application file for complete search history.

(56) References Cited

U.S. PATENT DOCUMENTS 2,249,296 A * 7/1941 Livingston ..... 450/58
3,311,112 A * 3/1967 Murray ..... 450/1
3,826,266 A * 7/1974 Alpert ..... 450/11
4,325,378 A * 4/1982 Wilkinson ..... 450/77
5,098,330 A * 3/1992 Greenberg ..... 450/55
5,679,052 A * 10/1997 Rucki ..... 450/57
6,063,110 A * 5/2000 Stedman ..... 607/108
6,283,820 B1 * 9/2001 Huang ..... 450/57
6,394,879 B1 * 5/2002 Paige ..... 450/38
6,406,351 B1 * 6/2002 Chen ..... 450/55

* cited by examiner

*Primary Examiner*—Gloria M. Hale
(74) *Attorney, Agent, or Firm*—Michael R. Philips

(57) ABSTRACT

The postpartum bra described utilizes a conically formed ice replacement pack laminated between an outer and an inner insulating layer of fabric as each of a pair of thermal bra cups. The bra cups are connected to a horizontal back strap by a pair of shoulder straps. The back strap and a connecting panel between the bra cups are elastic. A pair of adjustable connectors between the back strap and the bra cups allow the bra to be tightened selectively and successively as desired.

13 Claims, 3 Drawing Sheets

BRA FOR POSTPARTUM NON NURSING MOTHERS

FIELD OF THE INVENTION

The present invention relates to the field of undergarments for women, and more particularly to a bra for use by a non nursing mother during the postpartum period to reduce the accumulation of breast milk and associated pain.

BACKGROUND OF THE INVENTION

The female mammary glands produce milk in the time following childbirth as a natural feeding method for the newborn infant. Milk is produced and stored in the mother's breasts from the time of delivery until several days after the cessation of breast feeding by the baby. For various reasons, some women choose not to breast feed their newborns, but to feed by means of a bottle containing commercially available baby formulas. Irrespective of the decision to bottle feed, the new mother's body produces and stores milk in anticipation the newborn baby's needs. When the milk is not removed from the breasts by a nursing infant, the breasts become engorged and painful.

In the past, a hormonal drug such as Deladumone was prescribed to inhibit the production of milk in the breasts of the non nursing mother, correcting the problem in a relatively short time. However, this practice was discontinued several years ago when long-term side effects of hormone therapy were often found to be potentially dangerous. The selected replacement for hormonal drugs has been the application of cold packs directly to the breasts, while physically constricting the breasts. The cold discourages milk production, and the constriction, or binding of the breasts, prevents significant milk storage. This treatment has been accomplished by placing a cold medium, such as a flexible ice replacement pack, into the bra of the non nursing mother. Such a flexible ice replacement pack is available from Chillerz (www.chillerz.com). Flexible ice replacements are typically a plastic bag filled with a semi-liquid that retains cold, but does not freeze to a solid at the temperature of a home freezer. Alternately, chilled cabbage or similar leaves are used. Concurrently, the breasts would be bound with a constricting binder, such as an "ace bandage," to apply pressure on top of the cold medium.

While these measures of cooling and compressing were reasonably effective, wearing in one's bra a rectangular-shaped sack of cold, semi-liquid material that is no more than moderately bendable, or using chilled cabbage leaves, is hardly convenient and barely tolerable. In addition, the ice replacement pack is uncomfortably cold in direct contact with the skin, and the cabbage leaves do not remain cold for an extended period, thus requiring frequent replacement.

The present invention, described and claimed in detail below, provides an improved bra for use by non nursing mothers to diminish the production of breast milk and overcome the drawbacks of the prior methods. In addition, it is contemplated that since the period for elimination of breast milk is no more than several days to a week, the bra of the invention will have a short useful life and must be relatively inexpensive.

SUMMARY OF THE INVENTION

The bra for postpartum, non nursing mothers is shaped similarly to known bras, with the added features of including thermal elements in the bra cups and an improved size adjustment mechanism to apply pressure, reducing the retention of milk. The term thermal is intended to mean able to absorb and transmit heat, i.e. by cooling the breasts of the non nursing mother. The bra cup is formed with an outer insulating layer and an inner insulating layer with a thermal element laminated therebetween. The thermal element is formed of a conical outer sheet and a conical inner sheet peripherally sealed to one another and encapsulating a quantity of thermal semi-liquid capable of being brought to a desired temperature and remaining cold over many hours. The bra is worn by closing adjustable means at the left and right sides enabling the user to periodically tighten the cups to the body as the breast milk quantity is diminished.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
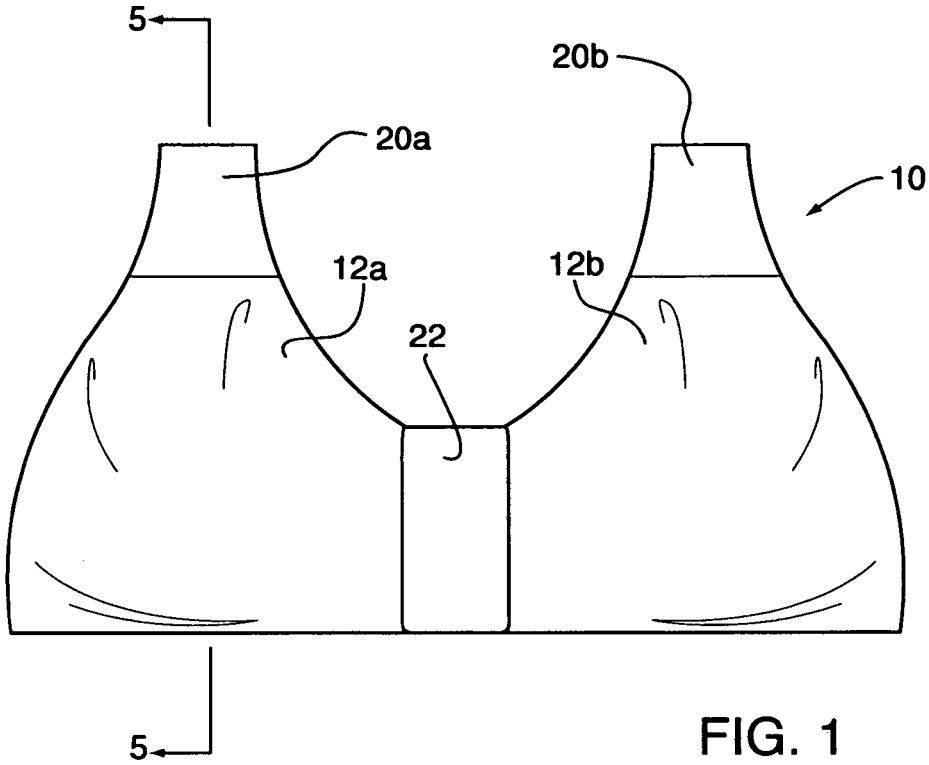
FIG. 1 is a front elevation view of the bra of the present invention.

In reference to FIG. 1, bra 10 for postpartum, non nursing mothers includes a right thermal cup 12*a* and a left thermal cup 12*b* that are generally formed conically to be comfortable to the wearer. Right cup 12*a* is connected to left cup 12*b* by a connecting panel 22, preferably formed of an elastic material. A right shoulder strap 20*a* is connected to right cup 12*a*, and a left shoulder strap 20*b* is connected to left cup 12*b*, as is known. The various components of the invention bra 10 are assembled to one another by any convenient means, typically by stitching. It is understood that bra 10 is depicted in concept, and is adaptable to being manufactured in any range of sizes as is known in the trade.

Figure 2:
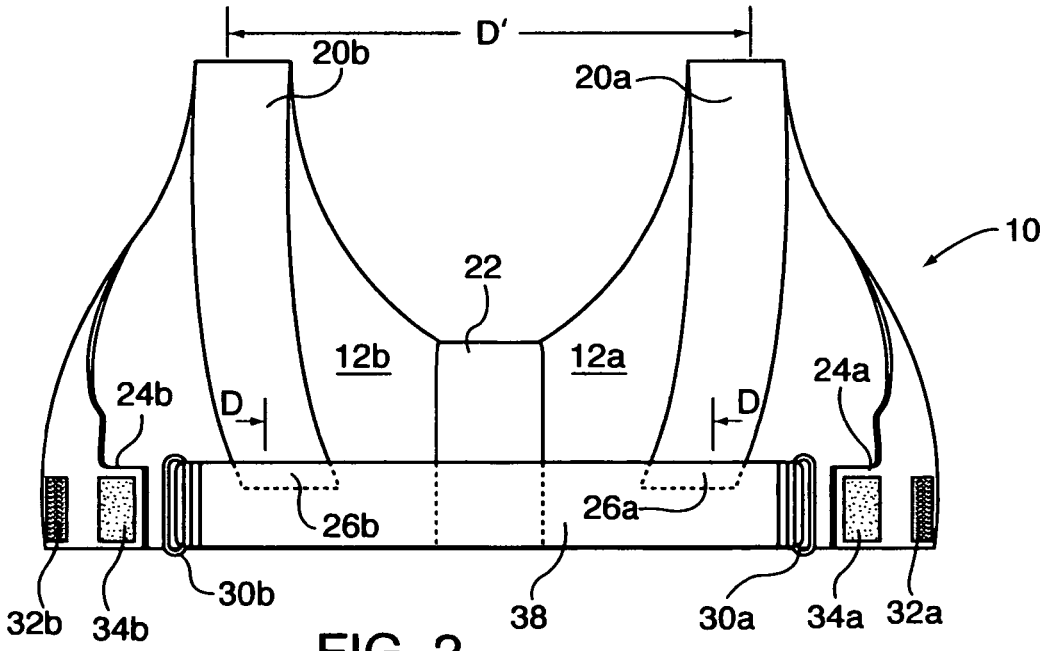
FIG. 2 is a rear elevation view of the bra of FIG. 1.
Figure 3:
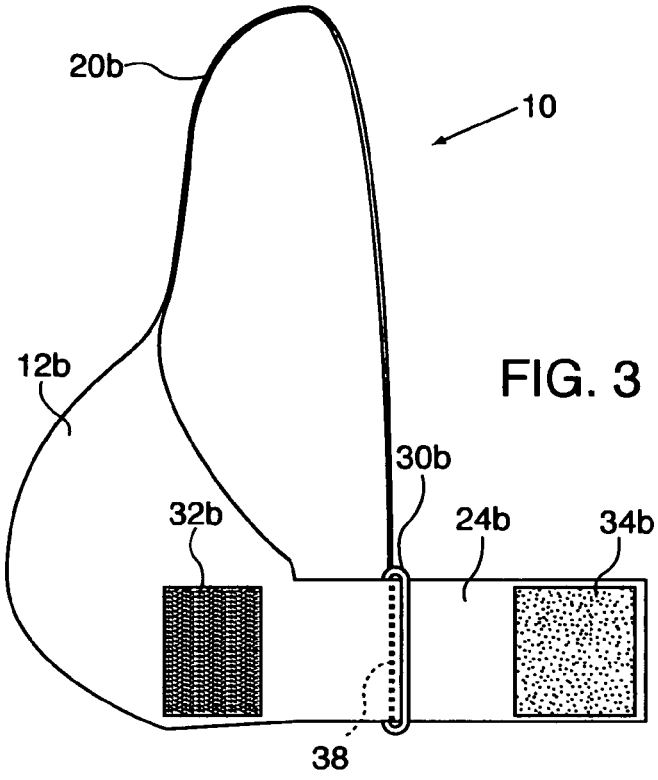
FIG. 3 is a left side view of the bra of FIG. 1 with its side belt passing through a receptor loop prior to closing.
Figure 4:
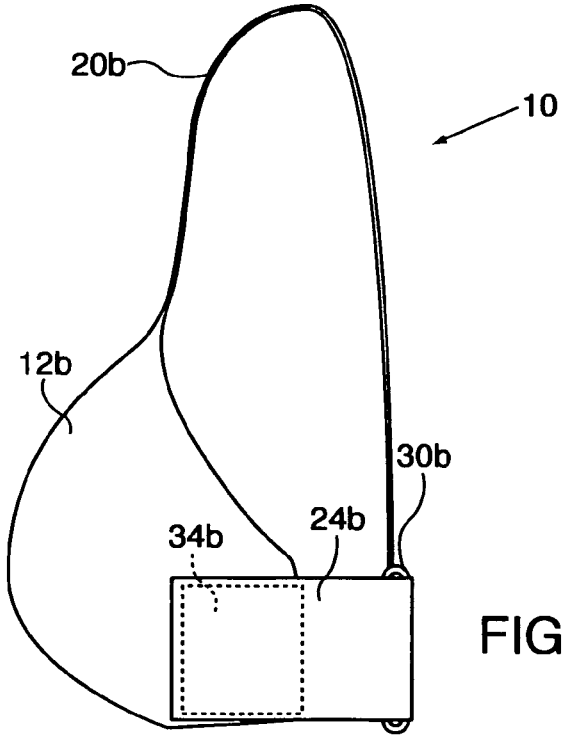
FIG. 4 is a left side view of the bra of FIG. 1 with its side belt passing through a receptor loop after closing.

Referring now to the rear view of FIG. 2 and left side view of FIG. 3, a single back strap 38 is assembled in substantially perpendicular relation to a second end of each of left and right shoulder straps 20*a* and 20*b*. Back strap 38 is preferably formed of an elastic material. The junctures 26*a* and 26*b* where shoulder straps 20*a*, 20*b* are connected to back strap 38 are spaced at distance D from one another. Distance D is less than the distance D' between the upper arcs of shoulder straps 20*a* and 20*b*. A first side belt 24*a* is assembled to the lower outer edge of right bra cup 12*a*, and a second side belt 24*b* is assembled to the lower outer edge of left bra cup 12*b*. A connector element 32*a* is assembled to the lower side portion of right bra cup 12*a* and a mating connector element 34*a* is assembled to a matching position on the surface of side belt 24*a*. A connector element 32*b* is assembled to the lower side portion of left bra cup 12*b* and a mating connector element 34*b* is assembled to a matching position on the surface of side belt 24*b*. In the illustrated embodiment of the invention, connector elements 32*a*, 34*a* and 32*b*, 34*b* are hook-and-loop type elements (e.g. Velcro®), while additional connector types, such as snaps or hooks and eyes, may be utilized. A pair of side belt receptors, shown as elongate loops 30*a* and 30*b*, are assembled to the opposed ends of back strap 38. In use, the wearer places bra 10 over her head and inserts respective side belts 24*a*, 24*b* through loops 30*a* and 30*b*, then engages connector elements 32*a* and 34*a*, 32*b* and 34*b* as shown in FIG. 4 to secure bra 10 around the body. Elongate loops are preferred to keep side belts 24*a* and 24*b* flat against the side of the wearer's body. The sizing and tightness of bra 10 may thus be adjusted by selecting the preferred position of mating connector elements 32, 34. As bra 10 is adjusted more tightly with connector elements 32 and 34, elastic back strap 38 is caused to elongate, increasing the distance D between the lower junctures 26*a*, 26*b* to somewhat straighten the rear portions of shoulder straps 20*a*, 20*b*. Whereas connecting panel 22 is elastic, the modulus of elasticity of back strap 38 is preferably greater than the modulus of elasticity of connecting panel 22 to compensate for the difference in geometry. The dimensions and degree of elasticity of each component is left to the discretion of the designer. It is further contemplated that the connector elements 32, 34 and loop 30 may be a single connector set located at any convenient position around the circumference of bra 10, or alternately, having connector elements mounted on either end of an elongate back strap and a loop strap receptor assembled to an outer edge of each bra cup.

Figure 5:
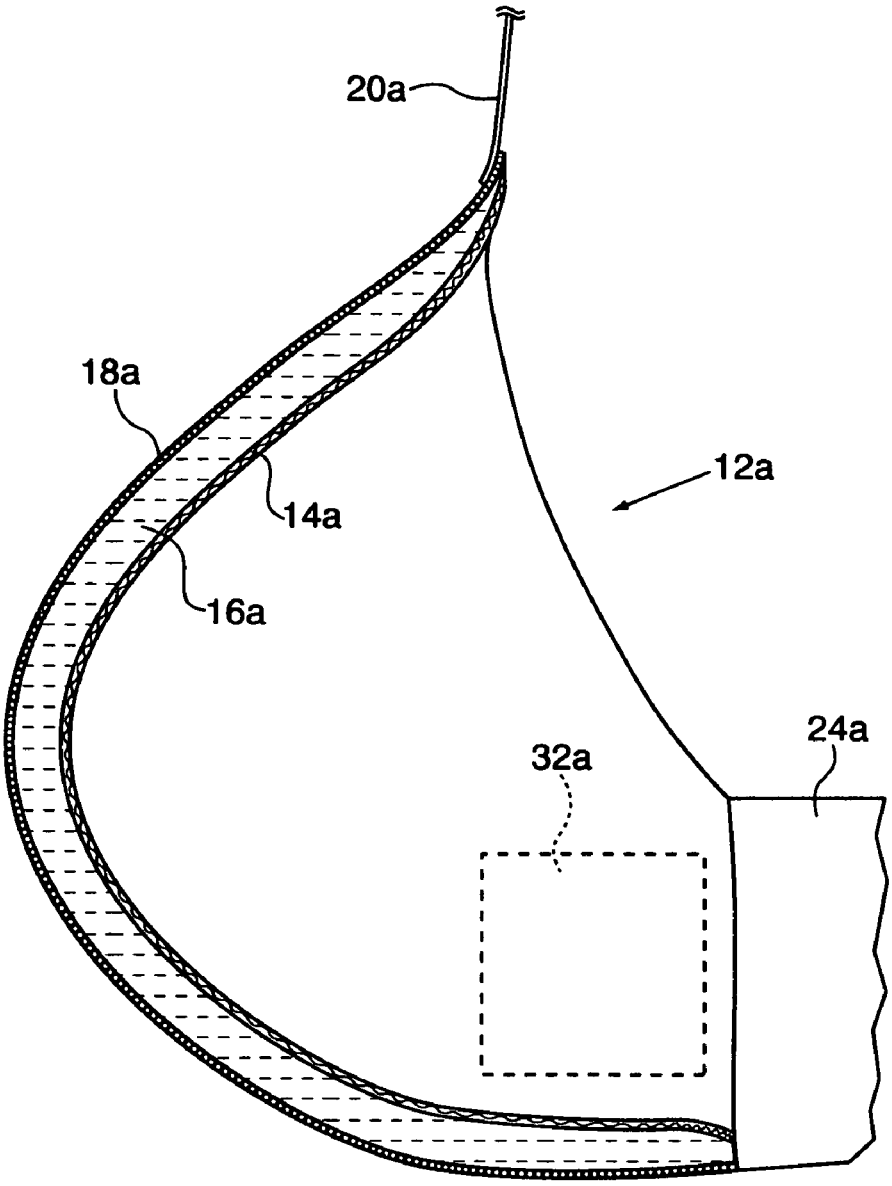
FIG. 5 is an enlarged cross sectional view of the bra taken along line 5—5 of FIG. 1.

FIG. 5 illustrates an enlarged cross section of a typical thermal bra cup, e.g. right bra cup 12*a*, to describe the detail of construction thereof. Shoulder strap 20*a* and side belt 24*a* are shown as being cut off to focus the following description on bra cup 12*a*. The body of bra cup 12*a* is formed as a three-layer laminate comprising inner layer 14*a*, thermal middle layer 16*a* and outer layer 18*a*. Inner layer 14*a* and outer layer 18*a* are formed of insulating fabric. The term thermal as used herein may refer to a substantially warm or a substantially cold component that is capable of absorbing and transmitting heat. Middle layer 16*a* is formed as a substantially conically shaped flexible ice replacement pack containing the above described semi-liquid that is capable of maintaining a selected temperature for an extended period of time. If the selected temperature is low, the semi-liquid retains its flexibility to a far lower temperature than the freezing point of water, thus being relatively comfortable for the wearer. As will be apparent to those skilled in the art, thermal layer 16*a* may be warmed and used to apply heat therapy for appropriate purposes. In certain cases, application of warmth or heat to the breast of a nursing mother has been prescribed to improve the flow of milk for feeding.

Inner layer 14*a* acts both as the main support member for the breast and as an insulating barrier within thermal layer 16*a* so that the extreme coldness (or heat) is not in direct contact with the skin. Otherwise, both discomfort and possible damage to the skin surface might occur. The inner surface of inner layer 14*a*, being in direct contact with the skin, must be comfortable to the touch. Outer layer 18*a* acts mainly as an insulating barrier to minimize the amount of thermal transfer occurring between thermal layer 16*a* and the surrounding atmosphere, with the temperature differential providing maximum benefits the wearer. Therefore, it is preferred that outer layer 18*a* has a higher insulation factor than inner layer 14*a* to allow optimum heat flow from the breast to thermal layer 16*a* with a minimal amount of heat entering thermal layer 16*a* from ambient air. In one embodiment of the invention, a thin layer of heat-reflective material such as a metallic Mylar® may be used as a part of insulating layer 18*a*. During the process of elimination of milk from the breast of the non nursing mother, side belts 24*a*, 24*b* are gradually tightened to maintain pressure on the breasts, the continuous pressure being assisted by the effect of the elasticity of connecting panel 22 and back strap 38.

Whereas the primary use for the present invention is to suppress milk production and eliminate associated pain, it is an objective to gradually reduce the size of the breast as the process proceeds. Both the effect of the cold and the binding pressure provided by the adjustable connector elements and elastic components promote this objective. It is further contemplated that temperatures more moderate than freezing would be effective in suppressing milk production, although a greater length of time would likely be required.

While the description above discloses preferred embodiments of the present invention, it is contemplated that numerous variations and modifications of the invention are possible and are considered to be within the scope of the claims that follow.

What is claimed is:

1. A bra for use by a non nursing mother after childbirth, comprising:

a. a first thermal bra cup and a second thermal bra cup each formed with an outer thermally insulating layer including a heat-reflective sheet, an inner thermally insulating layer, and a thermal middle layer, and wherein the outer insulating layer has a higher insulation factor than the inner insulating layer, the first and second thermal bra cups being assembled to a connecting panel disposed therebetween;

b. a shoulder strap connected to an upper portion of each first and second bra cup by a first end thereof;

c. a back strap having two opposed ends and connected at spaced apart positions to a second end of each of the shoulder straps;

d. a side belt connected to a side portion of each first and second bra cup by a first end thereof;

e. a side belt receptor connected to each end of the opposed ends of the back strap;

f. a first connector element connected at a side portion of each of the first and second bra cup; and g. a second connector element connected at a second end of each of the side belts allowing each side belt to pass through each respective side belt receptor, each second connector element being able to releasably engage a respective first connector element.

2. The bra described in claim 1, wherein the thermal middle layer is formed of a material capable of retaining a temperature to which the layer is exposed.

3. The bra described in claim 1, wherein the thermal middle layer is formed of a semi-liquid able to remain substantially flexible at temperatures below the freezing point of water.

4. The bra described in claim 1, wherein the second ends of the shoulder straps reside closer to one another than the portion of the shoulder straps passing over the shoulder of the wearer.

5. The bra described in claim 1, wherein the first and second connector elements comprise a hook and loop fastener.

6. The bra described in claim 1, wherein the side belt receptor comprises an elongate loop.

7. The bra described in claim 1, wherein the connecting panel is formed of an elastic fabric and the back strap is formed of an elastic fabric.

8. A bra for use by a non nursing mother for the suppression of milk production, comprising:

a. a pair of bra cups connected to one another with each bra cup connected to a shoulder strap;

b. a back strap connected in substantially perpendicular relation to a second end of each of the shoulder straps;

c. connector elements to releasably connect the back strap to the bra cups for adjusting the tightness of the bra around the body of the wearer; and d. each of the pair of bra cups comprising an outer insulating layer including a heat-reflective sheet, an inner insulating layer and a thermal middle layer.

9. The bra described in claim 8, wherein the thermal middle layer is formed of a semi-liquid material able to remain substantially flexible at temperatures below the freezing point of water.

10. The bra described in claim 8, wherein the outer insulating layer has a higher insulation factor than the inner insulating layer.

11. The bra described in claim 9, further comprising side belt receptors formed as an elongate loop.

12. The bra described in claim 8, further comprising a connecting panel between the two bra cups formed of an elastic fabric and wherein the back strap is formed of an elastic fabric.

13. The bra described in claim 12, wherein the back strap has a higher modulus of elasticity than the connecting panel.

* * * * *